US007318588B1

(12) United States Patent
Miller

(10) Patent No.: US 7,318,588 B1
(45) Date of Patent: Jan. 15, 2008

(54) CARD GAME APPARATUS AND METHOD

(76) Inventor: Blaine P. Miller, 230 Ashland Dr., San Antonio, TX (US) 78218

( * ) Notice: Subject to any disclaimer, the term of this patent is extended or adjusted under 35 U.S.C. 154(b) by 326 days.

(21) Appl. No.: 11/129,705

(22) Filed: May 16, 2005

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS 1,568,206 A * 1/1926 Brandt ..... 273/296
3,428,323 A * 2/1969 Fried ..... 273/296
4,428,582 A * 1/1984 Smith ..... 273/296
D340,265 S 10/1993 St. Pierre
5,676,375 A * 10/1997 Pirouzkhah ..... 273/274
5,863,042 A 1/1999 Lo
2003/0160389 A1 8/2003 Loewenstein

* cited by examiner

*Primary Examiner*—Eugene Kim
*Assistant Examiner*—Dolores R. Collins

(57) ABSTRACT

A card game apparatus includes a deck of game cards that includes a plurality of sets of suited cards. The set of suited cards includes 5 suits. Sets of bonus point cards are included. The deck is placed face down in a random order an in a loose pile. One game card is drawn by each of the players in turn from the loose pile so that each player has a personal set of cards. The players follow the directions on the game cards. The directions include positioning the suited cards face up in the personal set of cards and attempting to form suited runs of 5 of the suited cards. The bonus point cards are also placed face up in the personal set of cards. A player having a required number of points in their personal set of cards wins the game.

15 Claims, 6 Drawing Sheets

CARD GAME APPARATUS AND METHOD

BACKGROUND OF THE INVENTION

1. Field of the Invention

The present invention relates to card games and more particularly pertains to a new card game for providing entertainment and strategy learning.

2. Description of the Prior Art

The use of card games is known in the prior art. U.S. Pat. No. 4,428,582 describes a card deck adapted for playing a plurality of card games for persons of varying ages and skills. Another type of card game is U.S. Pat. No. 1,568,206 a deck of cards and card game associated therewith. Yet another card game is described in U.S. Pat. No. 5,863,042.

While these devices fulfill their respective, particular objectives and requirements, the need remains for a card game that includes certain elements of traditional card games but which includes a plurality of secondary cards for adding different elements of strategy to the game. Additionally, the card game should be generally self-explanatory to a person playing the game so that the game may be enjoyed by persons of varying ages and skill levels.

SUMMARY OF THE INVENTION

The present invention meets the needs presented above by generally comprising a deck of game cards that includes a plurality of sets of suited cards. The set of suited cards includes 5 suits and each of the suits includes an ace, a one through a ten, a jack, a queen and a king so that each of the suits includes 13 cards. Sets of bonus point cards are included and each of the sets of bonus point cards has a bonus value that is different from remaining ones of the sets of bonus point cards. A random number generator is provided and a first player in turn is the player who has a highest number generated by the random number generator. The deck is placed face down in a random order an in a loose pile so that all players have access to each of the game cards. One game card is drawn by each of the players in turn from the loose pile so that each player has a personal set of cards. The players follow the directions on the game cards. The directions include positioning the suited cards face up in the personal set of cards and attempting to form suited runs of 5 of the suited cards. The bonus point cards are also placed face up in the personal set of cards. A player having a required number of points in their personal set of cards wins the game. The points are calculated by including 500 points for each run of 5, plus 5 points for each ace and each 2-10 suited card not in a run, plus 10 points for each jack, queen or king not in a run, plus any points indicated on any bonus point card.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
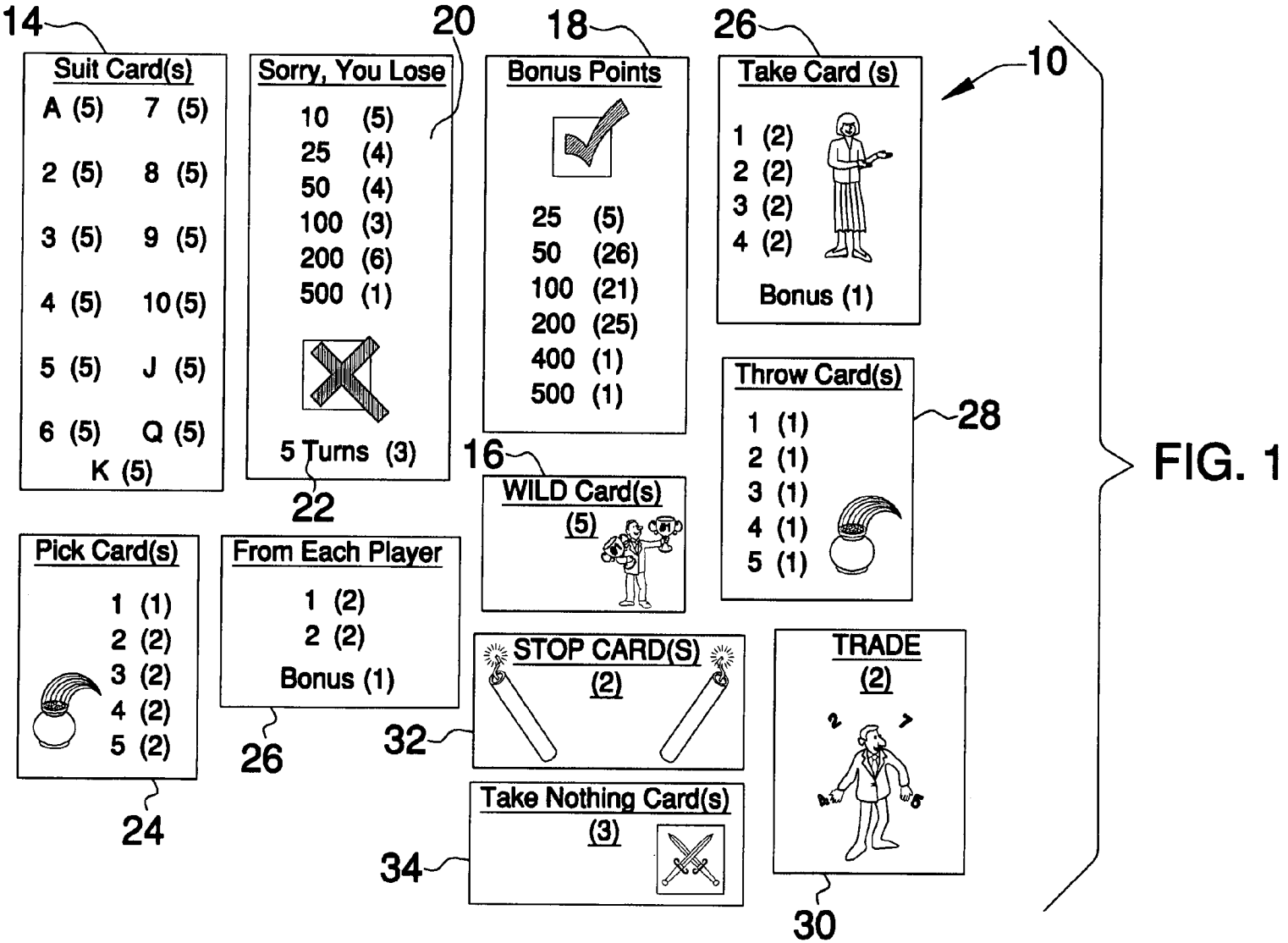
FIG. 1 is a schematic view of a general list of game cards a card game apparatus and method according to the present invention.
Figure 2:
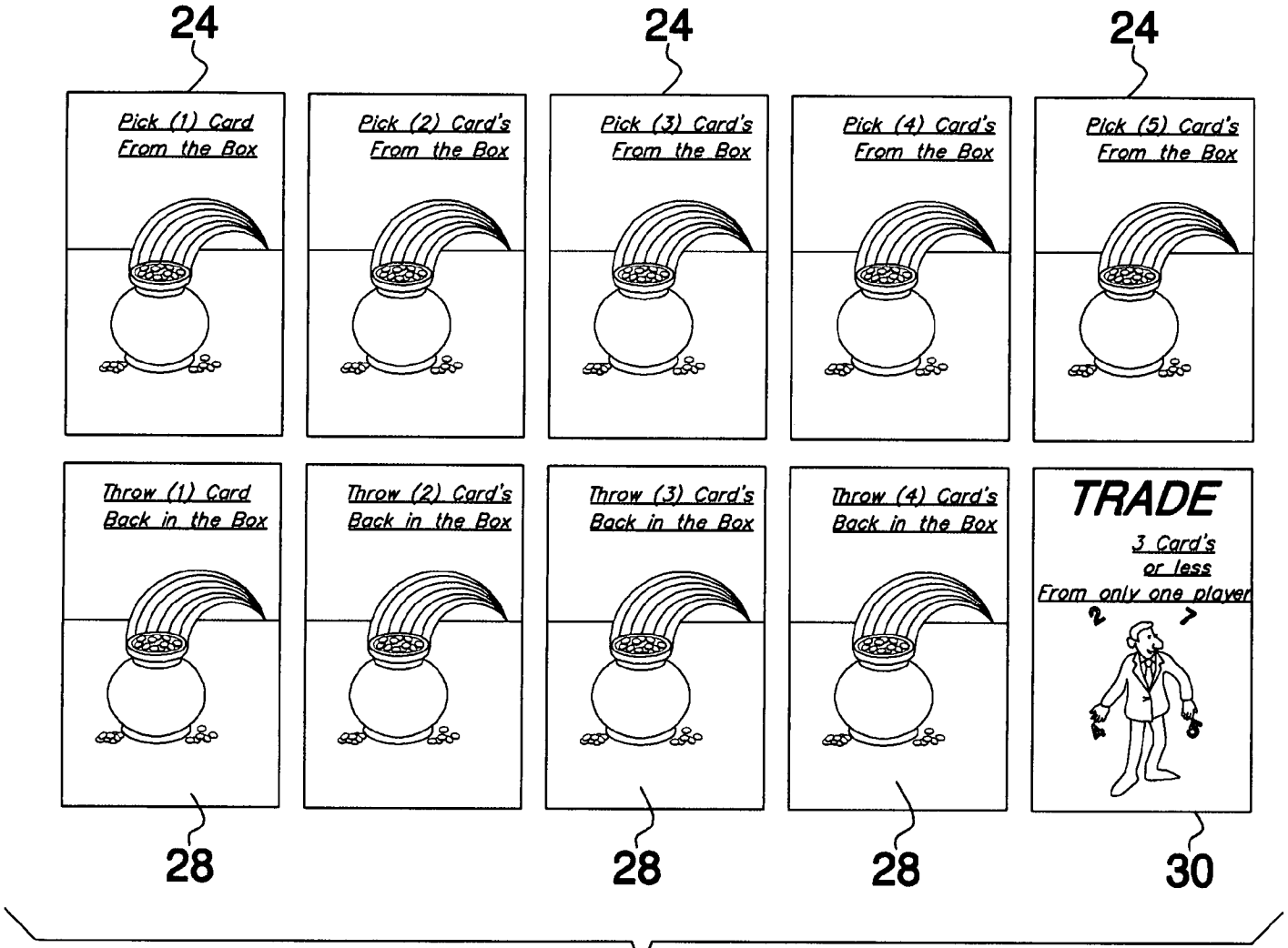
FIG. 2 is a front view of game cards of the present invention.
Figure 3:
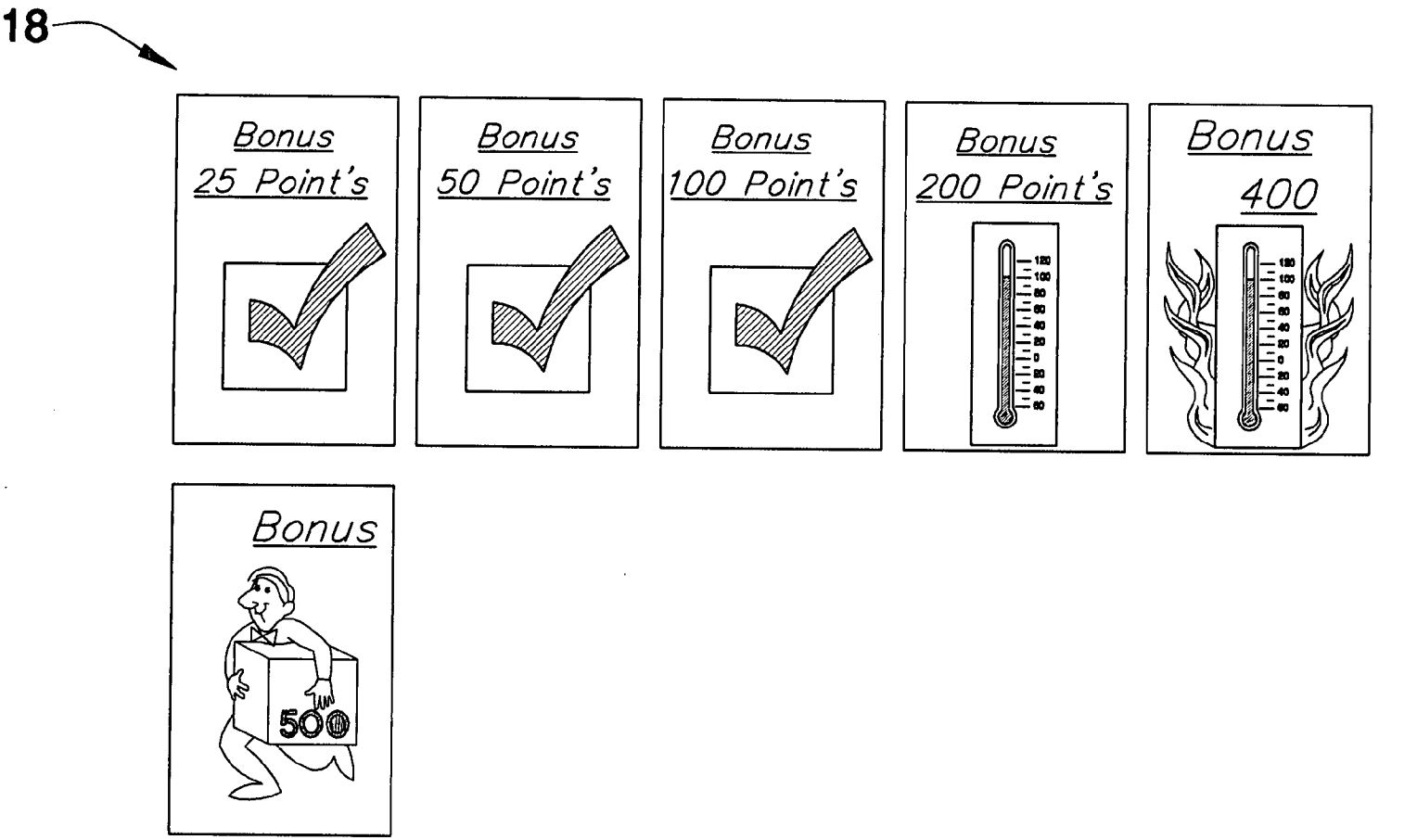
FIG. 3 is a front view of game cards of the present invention.
Figure 4:
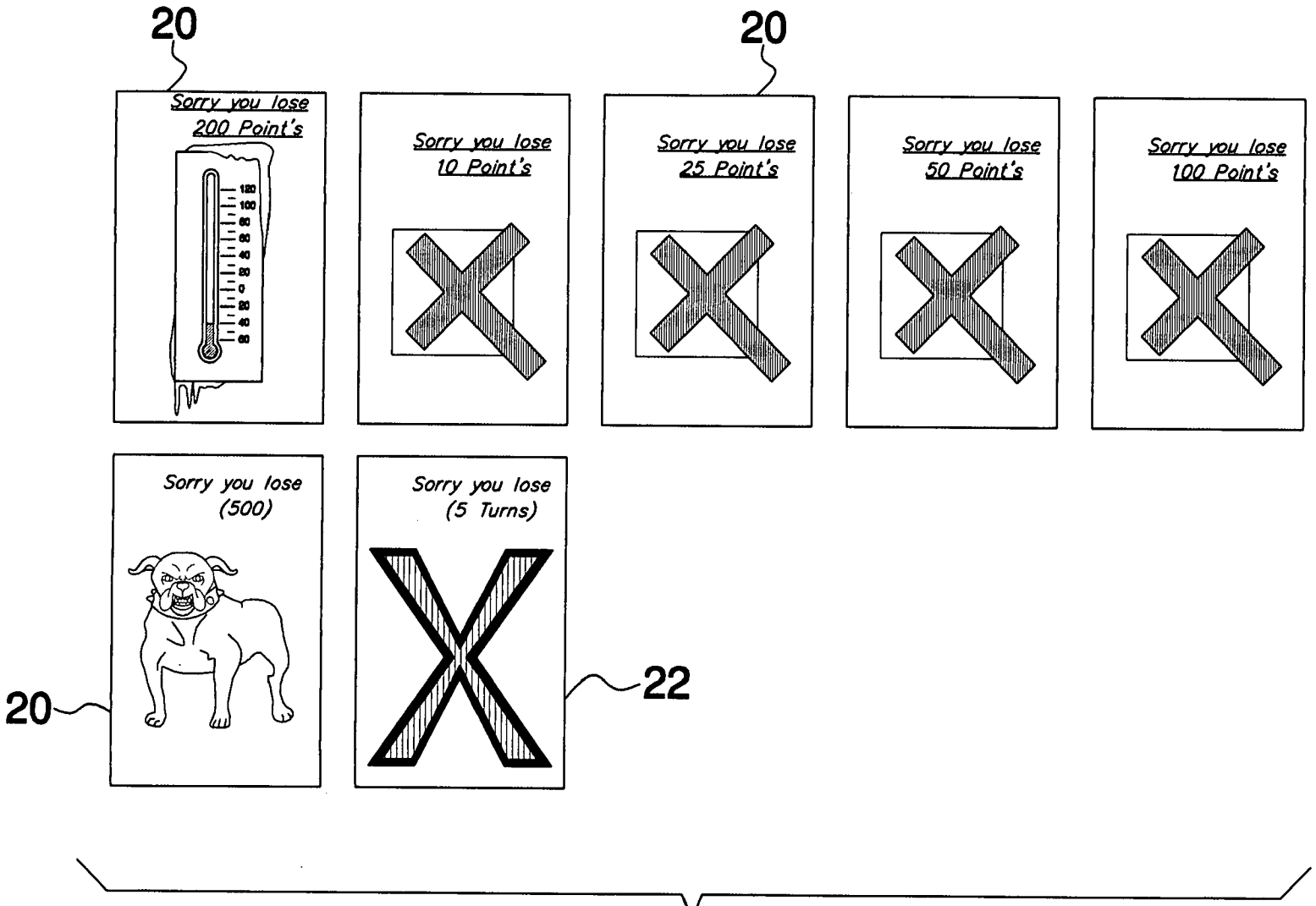
FIG. 4 is a front view of game cards of the present invention.
Figure 5:
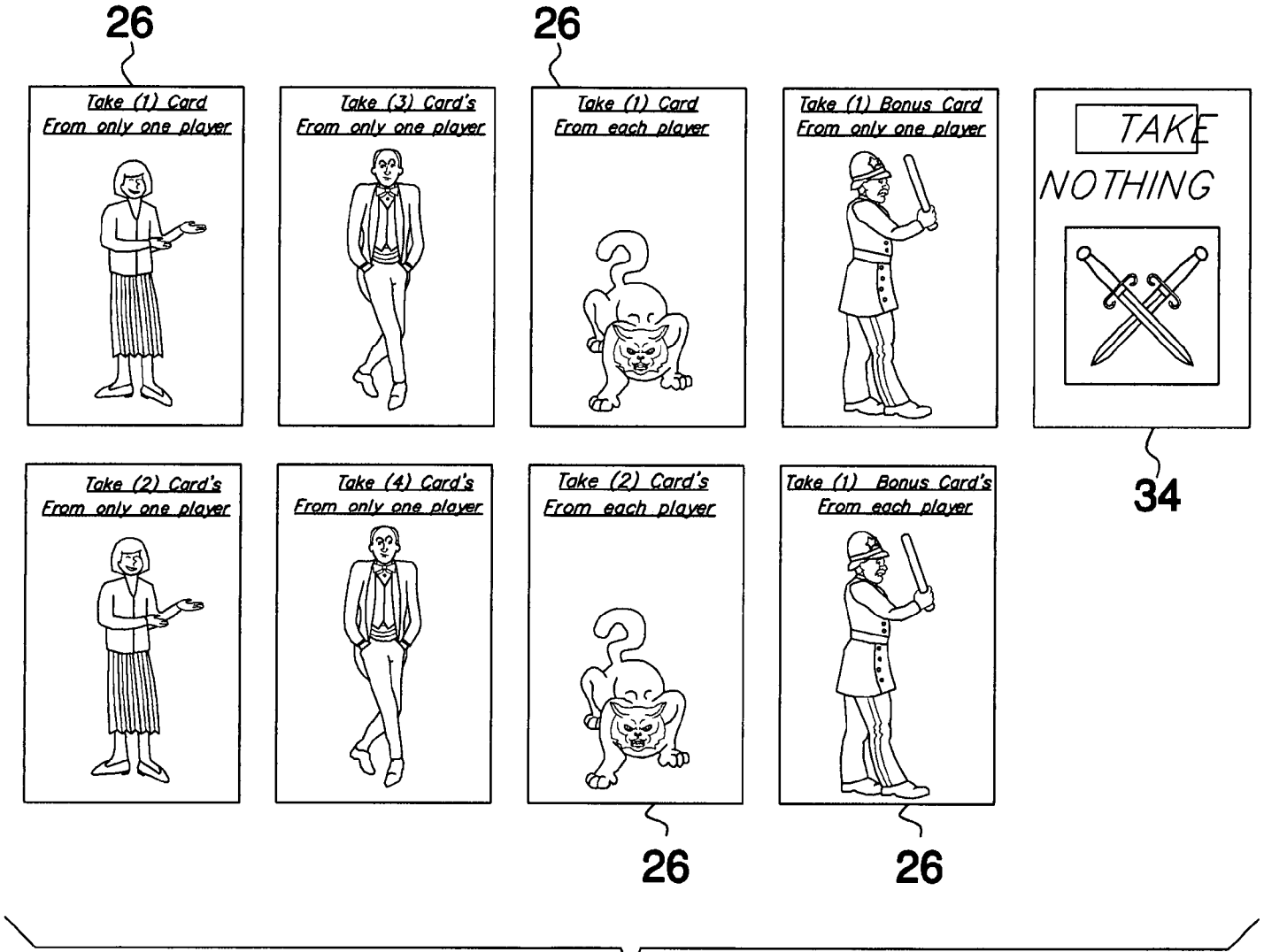
FIG. 5 is a front view of game cards of the present invention.
Figure 6:
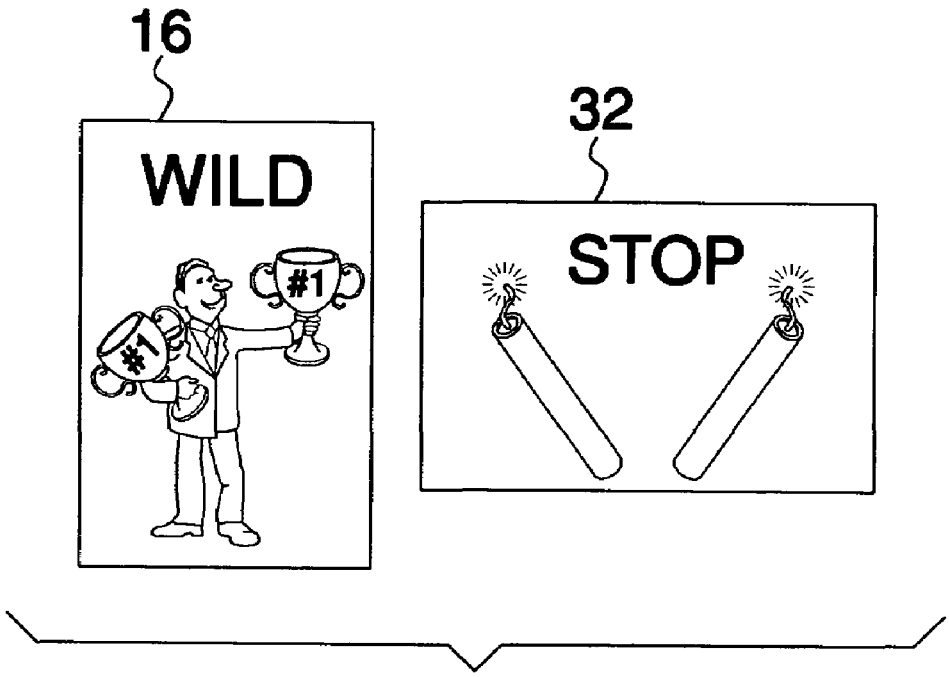
FIG. 6 is a front view of game cards of the present invention.
Figure 7:
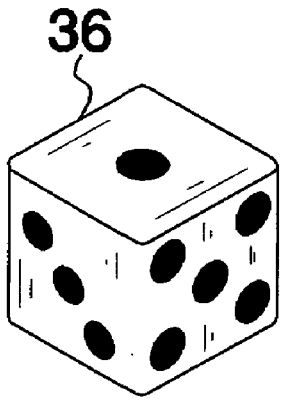
FIG. 7 is a perspective of a die of the present invention.

With reference now to the drawings, and in particular to FIGS. 1 through 7 thereof, a new card game embodying the principles and concepts of the present invention and generally designated by the reference numeral 10 will be described.

As best illustrated in FIGS. 1 through 7, the card game apparatus and method generally comprises providing a deck of game cards 10. The game cards 10 include a plurality of sets of suited cards 14. The set of suited cards 14 includes 5 suits. The suits include hearts, spades, diamonds, starts and clubs. Each of the suits includes an ace, a one through a ten, a jack, a queen and a king so that each of the suits includes 13 cards. A plurality of wild cards 16 is also provided and preferably includes 2 wild cards. Each of the suited cards 14 is replaceable by one of the wild cards 16.

A plurality of sets of bonus point cards 18 is provided. Each of the sets of bonus point cards 18 has a bonus value is different from remaining ones of the sets of bonus point cards 18. The bonus values are selected from the group consisting of 25 bonus points, 50 bonus points, 100 bonus points, 200 bonus points, 400 bonus points and 500 bonus points. Preferably, the bonus point cards 18 include five 25 point bonus cards, twenty-six 50 point bonus cards, twenty one 100 point bonus cards, twenty five 200 point bonus cards, one 400 point bonus card, and one 500 point bonus card.

A plurality of sets of negative point cards 20 is also provided. Each of the sets of negative point cards 20 has a negative value is different from remaining ones of the sets of negative point cards 20. The negative values are selected from the group consisting of 10 negative points, 25 negative points, 50 negative points, 200 negative points and 500 negative points. Preferably, the negative point cards 20 include five 10 negative point cards, four 25 negative point cards, four 50 negative point cards, three 100 negative point cards, six 200 negative point cards, and one 500 negative point card.

Lose turn cards 22 are also provided. Each of the lose turn cards 22 indicates a number of turns to be lost by a player drawing one of the lose turn cards 22. The number of turns to be lost is preferably five.

A plurality of bonus draw cards 24 are proved and each of the bonus draw cards 24 indicates a number of additional game cards 10 to be drawn by a player. The bonus draw cards 24 preferably include one draw 1 additional card 10 and two each of drawing 2, 3, 4 and 5 additional game cards 10.

Taking cards 26 are provided to indicate to a player that they may take a game card 10 from another opponent. The take cards 26 are grouped into take cards which allow one game card 10 to be removed from each of the other players, taking a plurality of game cards 10 from one other player, taking one bonus point card 20 from each of the other players or taking only a single bonus point card 20 from one player. A player having a take card 26, not indicating that a bonus point card 20 can be taken, cannot take a bonus point card 20 from another player.

A plurality of negative draw cards 28 is also provided. Each of the negative draw cards 28 indicates a number of game cards a player must return to the deck of game cards 10. A plurality of trade cards 30 is provided for indicating that a player may trade an indicated number of their cards with an equal number of an opponents cards. A plurality of stop cards 32 protect a player's cards from an opponents take card 26 or a trade card 30 and a plurality of take nothing cards 34 also protect a player's cards from an opponents take card 26 or a trade card 30.

A random number generator 36 is provided. This may be any conventional random number generator 36 but preferably includes a die. Each of the persons playing the game (players) takes turns actuating the random number generator 36. The player having a highest number generated by the random number generator is the first player to take a turn.

The deck of game cards 10 is placed face down in a random order an in a loose pile such that all players have access to each of the game cards 10. The deck may be placed in a box or other container to retain the deck in manageable space and to allow the deck to be easily passed around amongst the players. The players, in turn, draw one game card 10 from the loose pile so that each player has a personal set of cards, or each player establishes such after multiple turns.

Generally speaking, the players follow the directions on the game cards 10 as they are drawn. Below are the specifics of the game as the players draw the game cards 10.

Suited cards 14 are positioned face up in the personal set of cards for all to see. A player attempts to form suited runs of 5 with the suited cards 14. The suited runs may include up to one wild card 16 which replace one of the suited cards in a run of 5.

When a player receives a negative point card 20, they are placed face down in the personal set of cards. The player retains these cards until the end of the game. Bonus point cards 18 are placed faced up in the personal set of cards so that the player's opponents can see them.

A number of turns is lost by a player when a player draws the lose turn card 22. The number of turns the player will sit out is that indicated by the lose turn card 22 drawn. However, the lose turn cards 22 typically indicate that the player will lose 5 turns which are to be lost consecutively.

A player draws additional game cards 10 from the loose pile when the bonus draw cards 24 are drawn. The number of additional game cards 10 to be drawn is that indicated by the bonus draw card 24 drawn. Opposite of this, a player returns a number of game cards 10 from a player's personal set of cards to the loose pile when a negative draw card 28 is drawn. The player drawing a negative draw card 28 also looses a number of turns equal to a number of game cards 10 the player's personal set of cards is deficient to satisfy the number of game cards 10 indicated by the negative draw card 28. For example, if the player only has 3 game cards 10 in their personal set, but draws a negative 5 draw card 28, the player will lose all three game cards 10 and also must sit out 2 turns.

A player is allowed to remove number of game cards 10 from one or more opponents when a player draws a take card 26. The number to be removed from the opponent is indicated by the take card 26 and may include taking from multiple opponents as indicated above. Similar to this, a player may trade a number of game cards indicated by the trade card 30 with an opponent. Thus, if the trade card 30 indicates three cards are to be traded, the player will take three game cards 10 from an opponent and the opponent receives three of the player's game cards 10. The stop cards 32 and the take nothing cards 34 aid a player in preventing the loss of their cards to an opponent. A player can protect their personal set of cards for one round of turns by facing a stop card 32 up in the player's personal set of cards. The stop card 32 drawn is returned to the loose pile after the one round of turns. If a player forgets to return the stop card 32 to the loose pile, the player looses a number of turns equal to the number of turns taken by the other players before the player remembers to return the stop card 32. A player can protect their personal set of cards for a plurality of turns by facing a take nothing card 34 face up in the player's personal set of cards. The player selectively protects all of player's personal set of cards until an opponent removes the take nothing card 34 with a take card 26 or the player may permanently protecting one run of 5. The take nothing card 34 is returned to the loose pile if the take nothing card 36 is removed by an opponent's take card 26.

The game is won when a player has a required number of points in their personal set of cards. The required amount of points is preferably 10,000 points but the players may alter that number. The points are calculated by including 500 points for each run of 5, plus 5 points for each ace and each 2-10 suited card not in a run, plus 10 points for each jack, queen or king not in a run, plus any points indicated on any bonus point cards 18, and minus any points indicated on any negative point cards 20.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a card game by a plurality of players, said method comprising the steps of:

providing a deck of game cards, said game cards including;

a plurality of sets of suited cards, said set of suited cards including 5 suits, each of said suits including an ace, a one through a ten, a jack, a queen and a king such that each of said suits includes 13 cards;

a plurality of sets of bonus point cards, each of said sets of bonus point cards having a bonus value being different from remaining ones of said sets of bonus point cards;

providing a random number generator;

selecting a first player in turn having a highest number generated by said random number generator;

placing said deck face down in a random order an in a loose pile such that all players have access to each of said game cards;

drawing one game card by each of said players in turn from said loose pile such that each player has a personal set of cards;

following one of a plurality of game card directions based on the game card drawn, said game card directions including;

positioning said suited cards face up in said personal set of cards and attempting to form suited runs of 5 of said suited cards;

positioning said bonus point cards face up in said personal set of cards; and winning the game by a player having a required number of points in their personal set of cards, said points being calculated by including 500 points for each run of 5, plus 5 points for each ace and each 2-10 suited card not in a run, plus 10 points for each jack, queen or king not in a run, plus any points indicated on any bonus point card.

2. The method according to claim 1, wherein said game cards further include a plurality of wild cards, each of said suited cards being replaceable by one of said wild cards when forming a run of 5.

3. The method according to claim 1, wherein said bonus values are selected from the group consisting of 25 bonus points, 50 bonus points, 100 bonus points, 200 bonus points, 400 bonus points and 500 bonus points.

4. The method according to claim 1, wherein said game cards further include a plurality of sets of negative point cards, each of said sets of negative point cards having a negative value being different from remaining ones of said sets of negative point cards and subtracting points from a player's point total as indicated on said negative point cards.

5. The method according to claim 4, wherein said negative values are selected from the group consisting of 10 negative points, 25 negative points, 50 negative points, 200 negative points and 500 negative points.

6. The method according to claim 1, wherein said game cards further include a plurality of lose turn cards, each of said lose turn cards indicating a number of turns to be lost by a player drawing one of said lose turn cards, a player loosing a number of turns indicated by said lose turn cards.

7. The method according to claim 1, wherein said game cards further include a plurality of bonus draw cards, each of said bonus draw cards indicating a number of additional game cards to be drawn by a player, a player drawing a number of additional game cards from said loose pile indicated by said bonus draw cards.

8. The method according to claim 1, wherein said game cards further include a plurality of take card, each of said take card indicating a number of game cards a player will remove from each the player's opponents or a number of game cards the player will remove from one opponent, a player removing a number of game cards from one or more opponents indicated by said take card.

9. The method according to claim 1, wherein said game cards further include a plurality of negative draw cards, each of said negative draw cards indicating a number of game cards a player must return to said deck of game cards, a player returning a number of game cards from a player's personal set of game cards to said loose pile indicated by said negative draw card, the player drawing a negative draw card also loosing a number of turns equal to a number of game cards the player's personal set of game cards is deficient to satisfy the number of game cards indicated by said negative draw card.

10. The method according to claim 1, wherein said game cards further include a plurality of trade cards for indicating that a player may trade an indicated number of their cards with an equal number of an opponents cards, a player trading a number of game cards indicated by said trade card by a player with an opponent.

11. The method according to claim 8, wherein said game cards further include a plurality of trade cards for indicating that a player may trade an indicated number of their cards with an equal number of an opponents cards, a player trading a number of game cards indicated by said trade card by a player with an opponent.

12. The method according to claim 11, wherein said game cards further include a plurality of stop cards for protecting a player's cards from an opponents take card or a trade card, a player protecting their personal set of cards for one round of turns by facing a stop card up in the player's personal set of cards, said stop card drawn being returned to said loose pile after said one round of turns.

13. The method according to claim 12, wherein said game cards further include a plurality of take nothing cards for protecting a player's cards from an opponents take card or a trade card, a player protecting their personal set of cards for a plurality of turns by facing a take nothing card face up in the player's personal set of cards, the player selectively protecting all of player's personal set of cards until an opponent removes said take nothing card with a take card or the player may permanently protecting one run of 5, said take nothing card being returned to the loose pile if said take nothing card is removed by an opponent's take card.

14. The method according to claim 11, wherein said game cards further include a plurality of take nothing cards for protecting a player's cards from an opponents take card or a trade card, a player protecting their personal set of cards for a plurality of turns by facing a take nothing card face up in the player's personal set of cards, the player selectively protecting all of player's personal set of cards until an opponent removes said take nothing card with a take card or the player may permanently protecting one run of 5, said take nothing card being returned to the loose pile if said take nothing card is removed by an opponent's take card.

15. A method of playing a card game by a plurality of players, said method comprising the steps of:

providing a deck of game cards, said game cards including;

a plurality of sets of suited cards, said set of suited cards including 5 suits, each of said suits including an ace, a one through a ten, a jack, a queen and a king such that each of said suits includes 13 cards;

a plurality of wild cards, each of said suited cards being replaceable by one of said wild cards;

a plurality of sets of bonus point cards, each of said sets of bonus point cards having a bonus value being different from remaining ones of said sets of bonus point cards, said bonus values being selected from the group consisting of 25 bonus points, 50 bonus points, 100 bonus points, 200 bonus points, 400 bonus points and 500 bonus points;

a plurality of sets of negative point cards, each of said sets of negative point cards having a negative value being different from remaining ones of said sets of negative point cards, said negative values being selected from the group consisting of 10 negative points, 25 negative points, 50 negative points, 200 negative points and 500 negative points;

a plurality of lose turn cards, each of said lose turn cards indicating a number of turns to be lost by a player drawing one of said lose turn cards;

a plurality of bonus draw cards, each of said bonus draw cards indicating a number of additional game cards to be drawn by a player;

a plurality of take card, each of said take card indicating a number of game cards a player will remove from each the player's opponents or a number of game cards the player will remove from one opponent;

a plurality of negative draw cards, each of said negative draw cards indicating a number of game cards a player must return to said deck of game cards;

a plurality of trade cards for indicating that a player may trade an indicated number of their cards with an equal number of an opponents cards;

a plurality of stop cards for protecting a player's cards from an opponents take card or a trade card;

a plurality of take nothing cards for protecting a player's cards from an opponents take card or a trade card;

providing a random number generator;

selecting a first player in turn having a highest number generated by said random number generator;

placing said deck face down in a random order an in a loose pile such that all players have access to each of said game cards;

drawing one game card by each of said players in turn from said loose pile such that each player has a personal set of cards;

following one of a plurality of game card directions based on the game card drawn, said game card directions including;

positioning said suited cards face up in said personal set of cards and attempting to form suited runs of 5 of said suited cards, said suited runs including up to one wild card replacing one of said suited cards in a run of 5;

positioning negative point cards face down in said personal set of cards;

positioning said bonus point cards face up in said personal set of cards;

loosing a number of turns indicated by said lose turn cards;

drawing a number of additional game cards from said loose pile indicated by said bonus draw cards;

removing a number of game cards from one or more opponents indicated by said take card;

returning a number of game cards from a player's personal set of cards to said loose pile indicated by said negative draw card, the player drawing a negative draw card also loosing a number of turns equal to a number of game cards the player's personal set of cards is deficient to satisfy the number of game cards indicated by said negative draw card;

trading a number of game cards indicated by said trade card by a player with an opponent;

protecting a player's personal set of cards for one round of turns by facing a stop card up in the player's personal set of cards, said stop card drawn being returned to said loose pile after said one round of turns;

protecting a player's personal set of cards for a plurality of turns by facing a take nothing card face up in the player's personal set of cards, the player selectively protecting all of player's personal set of cards until an opponent removes said take nothing card with a take card or the player may permanently protecting one run of 5, said take nothing card being returned to the loose pile if said take nothing card is removed by an opponent's take card; and winning the game by a player having a required number of points in their personal set of cards, said points being calculated by including 500 points for each run of 5, plus 5 points for each ace and each 2-10 suited card not in a run, plus 10 points for each jack, queen or king not in a run, plus any points indicated on any bonus point cards, minus any points indicated on any negative point cards, said required number being 10,000 points.

* * * * *